United States Patent [19]

Van Horne et al.

[11] 4,344,715

[45] Aug. 17, 1982

[54] MEANS FOR ATTACHING A TRACTOR DRIVE ASSEMBLY TO A PLATEN

[75] Inventors: Arthur C. Van Horne, Santa Clara; Russel E. Yarp, Sunnyvale, both of Calif.

[73] Assignee: Dataproducts Corporation, Woodland Hills, Calif.

[21] Appl. No.: 126,651

[22] Filed: Mar. 3, 1980

[51] Int. Cl.[3] ..... B41J 15/00

[52] U.S. Cl. ..... 400/616.1; 400/656; 226/74; 226/79

[58] Field of Search ..... 400/616, 616.1, 616.2, 400/616.3, 656; 226/74, 75, 76, 77, 78, 79, 80, 81, 82, 83, 84, 85, 86, 87

[56] References Cited

U.S. PATENT DOCUMENTS 2,842,250 7/1958 Furman et al. ..... 400/616.1

3,283,875 11/1966 Davies ..... 400/616.1

OTHER PUBLICATIONS

IBM Technical Disclosure Bulletin, "Transport for Metal-Coated Record Carrier", Bahr et al., vol. 17, No. 3, Aug. 1974, p. 777.

*Primary Examiner*—Ernest T. Wright, Jr.

*Attorney, Agent, or Firm*—Spensley, Horn, Jubas & Lubitz

[57] ABSTRACT

A locking system for directly clamping the tractor assemblies in a printer to the stationary platen in order to prevent any relative motion of the tractors with respect to the platen which may be caused by a lack of straightness of a drive bar which drives the tractors. The locking device includes an L-shaped lever which is pivotal so as to clamp a rearwardly extending portion of the platen between the bottom of the tractor and the top of a leg of the lever. The device may include a cam action locking knob which positively locks the lever in its clamped position. Both the lever and the knob are made of molded plastic. In order to balance the clamping force which is applied, a lever may be connected to each side of the tractor and actuated by a pair of connected cam action knobs. Several alternate locking systems are also disclosed.

12 Claims, 13 Drawing Figures

Fig. 9.
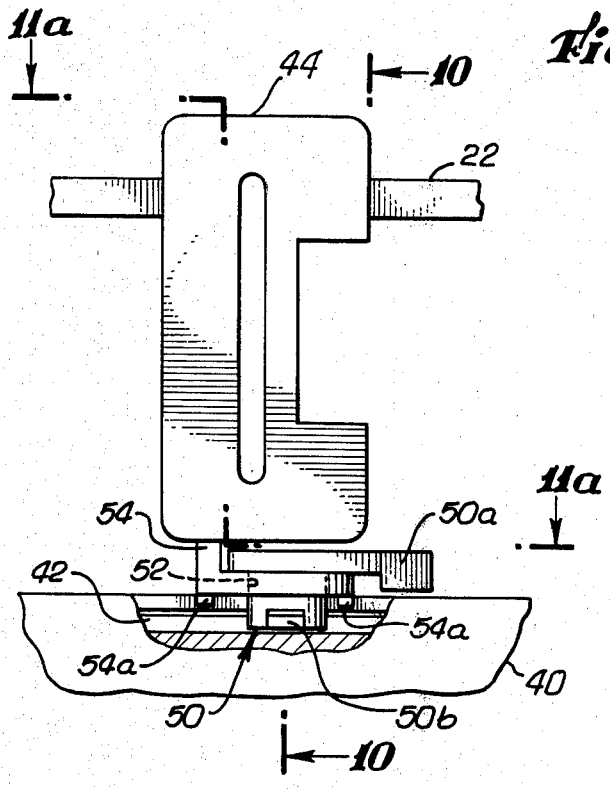
Fig. 10.
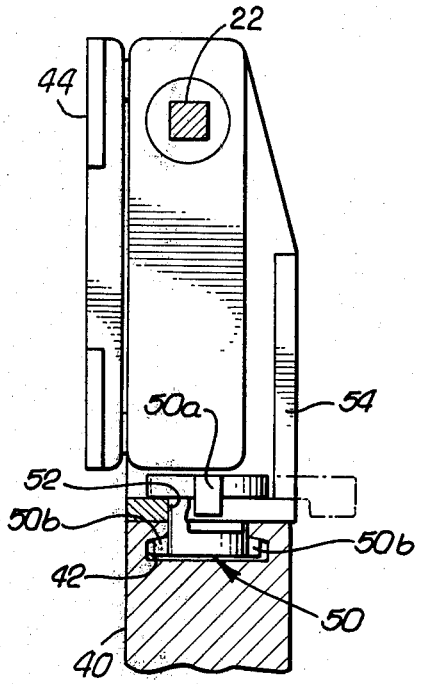
Fig. 11a.
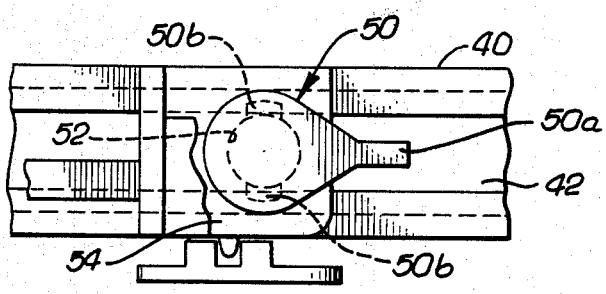
Fig. 11c.
Fig. 11b.
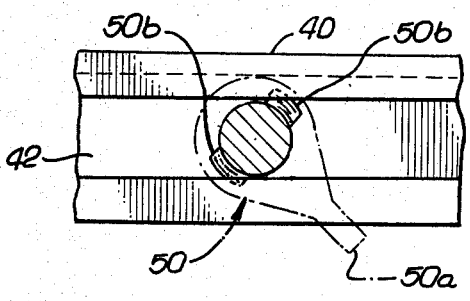
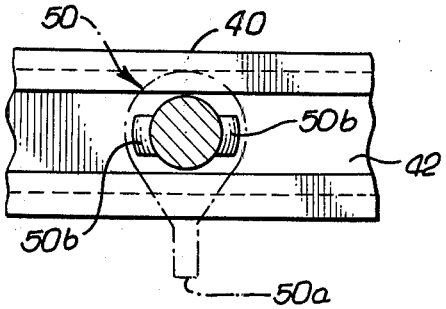

MEANS FOR ATTACHING A TRACTOR DRIVE ASSEMBLY TO A PLATEN

BACKGROUND OF THE INVENTION

1. Field of the Invention

This invention relates to paper drive systems for high speed printers or the like. More particularly, this invention relates to tractor-type paper drive systems.

2. Prior Art

Heretofore, in order to provide high accuracy incremental motion of paper in printers, a friction-feed system utilizing rubber rollers had to be employed. Tractor drive systems, which include a support bar to which the tractor is locked to eliminate horizontal motion of the tractor and a drive bar which is rotated so as to advance paper through the tractor, have the the disadvantage that the entire tractor assembly (including the support bar) could oscillate vertically due to a lack of straightness in the drive bar. The oscillation of the tractor decreases the accuracy of the positioning of the paper with respect to the printhead of a printer. It is a primary object of the present invention to provide a tractor-type paper drive which achieves high accuracy incremental motion of the paper in a printer. Another object of the present invention is to provide a high accuracy incremental paper drive system which is both simple and economical.

SUMMARY OF THE INVENTION

These and other objects are achieved by providing a tractor system which is locked directly to the platen of a printer. The position of the platen is fixed with respect to the printing mechanism (e.g., print head) of the printer, and the locking of the tractor to the platen head will eliminate any relative motion between the printing mechanism and the tractor. The locking of the tractor to the platen is accomplished by utilizing a modified platen which includes a rearwardly extending horizontal portion attached to the top of the platen. The bottom of the tractor assembly rests on the horizontal portion. An L-shaped locking lever includes a first leg which extends horizontally beneath the horizontal portion of the platen and a second leg which extends vertically along the side of the tractor. The lever is pivotal about a post which extends from the side of the tractor. When the lever is pivoted to a first position, the horizontal portion of the platen will be clamped between the bottom of the tractor and the top of the first leg of the lever. A cam lock is included on the side of the tractor to lock the lever in its first position.

In order to balance the clamping action provided between the tractor and the platen, a second lever may be included on the other side of the tractor and actuated by a second cam action knob which moves in conjunction with the first knob. In order to further balance the force applied to clamp the tractor to the platen, the ends of the first legs may be attached by means of a bar. The bar may be raised slightly with respect to the top of the legs and the horizontal portion of the platen may include a downwardly extending lip at its end so as to form a groove on the underside of the horizontal portion. The bar will then extend into the groove and improve the clamping action of the device.

In an alternate embodiment of the invention, a platen having a groove on its top surface is utilized. A T-shaped tongue on the bottom of the tractor fits into the groove in order to position the tractor. A generally L-shaped lock connected to the tractor locks into the groove in order to secure the tractor to the platen. The tongue and groove arrangement minimizes the tendency of the tractor to rock back and forth when a warped drive bar is used. In a second alternate embodiment the L-shaped lock is replaced by a rotating cylindrical lock. The cylindrical lock provides a more positive disengagement in an unlocked position than does the L-shaped lock.

BRIEF DESCRIPTION OF THE DRAWING

In the drawing:

FIG. 9 is a plan view of another alternate assembly utilizing a cylindrical lock;

FIG. 10 is a plan view taken along the section line 10—10 of FIG. 9;

FIG. 11*a* is a plan view taken along the section line 11*a*—11*a* of FIG. 9, and FIGS. 11*b* and 11*c* are plan views of an alternate assembly utilizing a cylindrical lock.

DETAILED DESCRIPTION OF THE INVENTION

Figure 1:
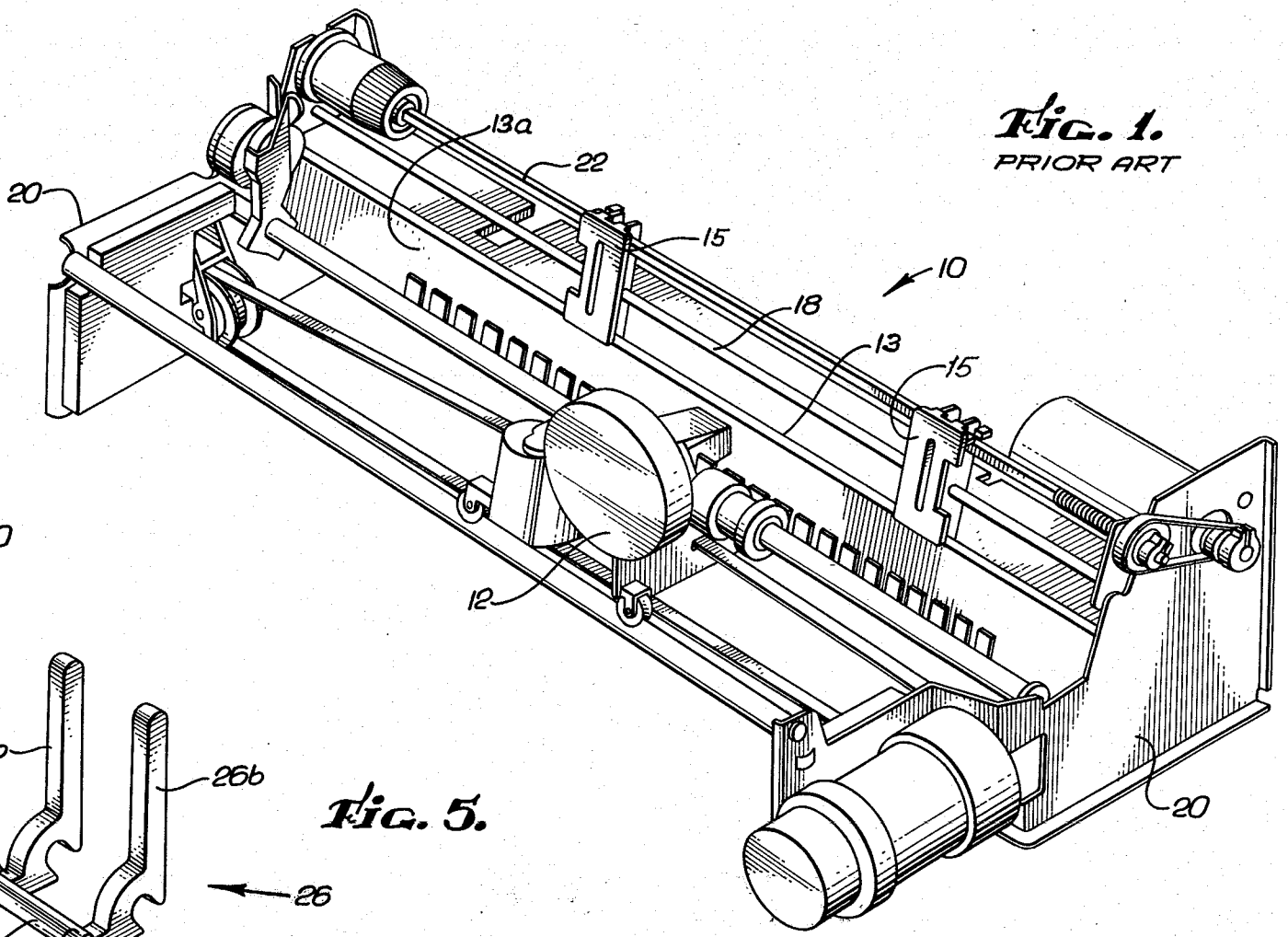
FIG. 1. PRIOR ART
FIG. 1 is a perspective view of a prior art printer showing a pair of paper drive tractors.

Referring to FIG. 1, a printer 10 includes a print head 12 supported in front of a platen 13. Paper 25 is drawn between the print head 12 and the vertical front portion 13*a* of the platen 13 by means of a pair of tractors 15. In the prior art the tractors 15 were supported by a support rod 18 connected to the sides 20 of the printer. A drive bar 22 is connected between the sides 20, and rotation of the drive bar 22 causes the tractors 15 to advance paper 25 through the tractors 15 and across the platen 13 in an incremental fashion.

In the printer shown in FIG. 1, there is no connection between the platen 13 and the tractors 15. Therefore, if the drive bar 22 were not completely straight, its rotation would cause the tractors 15 to oscillate vertically with respect to the platen 13. This results in inaccurate positioning of the paper 25 with respect to the print head 12.

Figure 3:
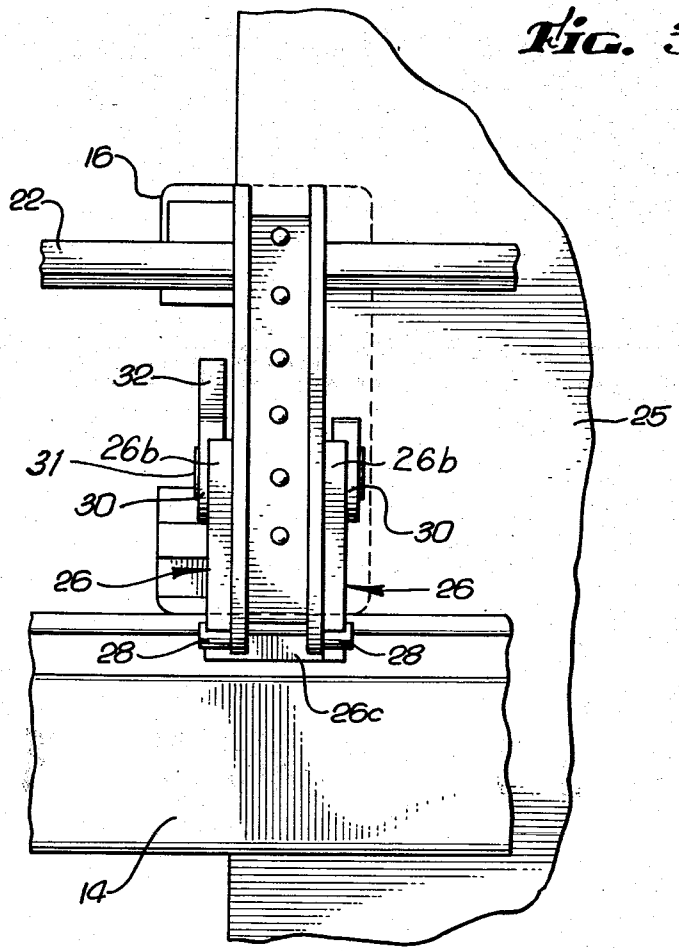
FIG. 3 is a rear plan view of the tractor assembly.
Figure 2:
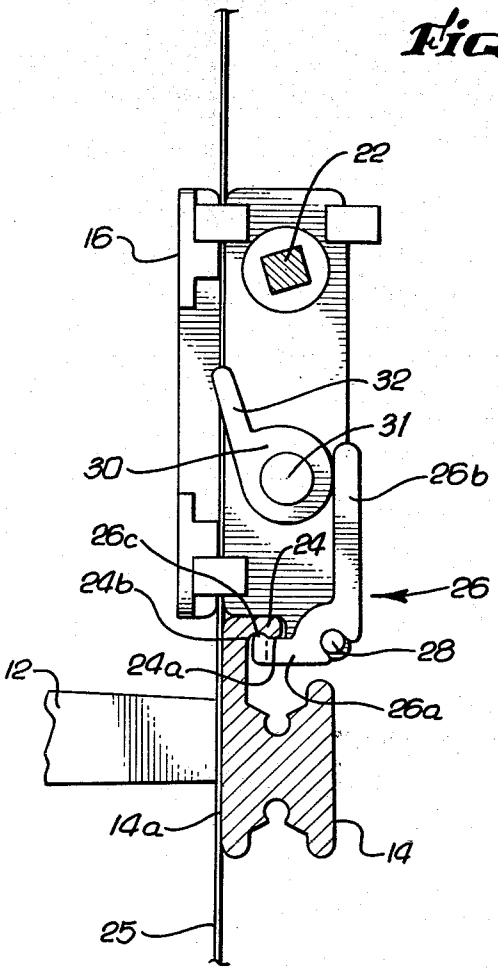
FIG. 2 is a side plan view of the tractor assembly of the present invention.
Figure 4:
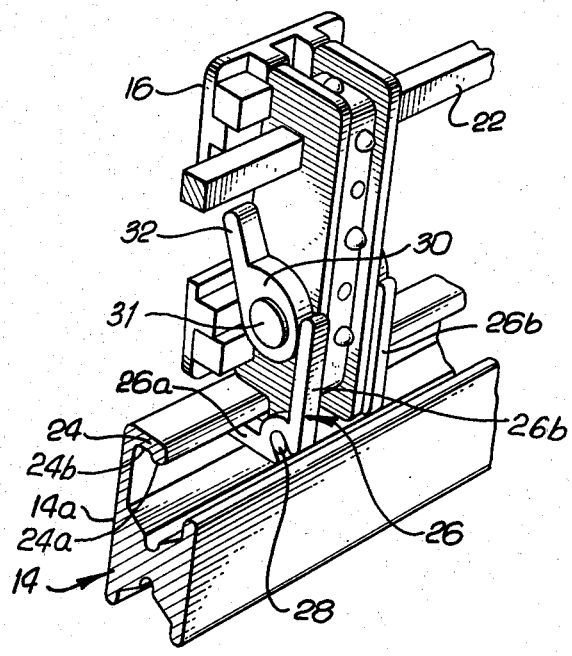
FIG. 4 is a perspective view of the tractor assembly.

FIGS. 2, 3 and 4 show the support system of the present invention, which is designed to be used in lieu of the support rod 18 of FIG. 1. The platen 14 has been modified so as to include a horizontal portion 24 which extends rearward from the top of the platen 14. The horizontal portion 24 includes a downwardly extending lip 24*a* which, along with the vertical front portion 14*a* of the platen 14, forms a groove 24*b* on the underside of the horizontal portion 24. A length of paper 25 is shown positioned between the print-head 12 and the platen 14 and within the tractor 16. A molded plastic locking lever 26 is positioned so as to cooperate with the horizontal portion 24 and effect a locking of the tractor 16 with respect to the platen 14. Specifically, the locking lever 26 is L-shaped and includes a first leg 26*a* which extends horizontally beneath the horizontal portion 24 and a second leg 26*b* which extends vertically along the side of the tractor 16. The lever 26 pivots about a post 28 which is attached to the side of the tractor 16. The action of the lever 26 is such that when the second leg 26*b* is forced rearward, the lever 26 will pivot about the post 28 and the first leg 26*a* will move vertically. This causes the horizontal portion 24 to be clamped between the bottom of the tractor 16 and the top of the leg 26*a*. The leg 26*a* also includes an upward projection 26*c* at its end which fits into the groove 24*b*, thus preventing the tractor 16 from coming loose from the platen 14 when the lever 26 is not secured.

Figure 6:
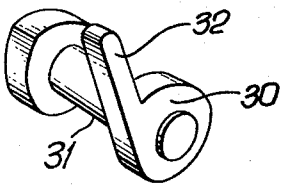
FIG. 6 is a perspective view of a cam action knob used to lock the locking lever.

In order to lock the lever 26 in its clamped position, a molded plastic cam action knob 30 (as shown in FIG. 6) is included and attached to the side of the tractor 16. The knob 30 may include a finger lever 32 to make its operation more convenient. When the knob 30 is rotated about pivot 31 in a clockwise direction, it will engage the leg 26*b* of the lever 26 and force it rearward, thus locking the lever 26 and clamping the tractor 16 to the platen 14. Friction between the knob 30 and the leg 26*b* will keep the knob 30 in a locked position until it is rotated in a counterclockwise direction.

Figure 5:
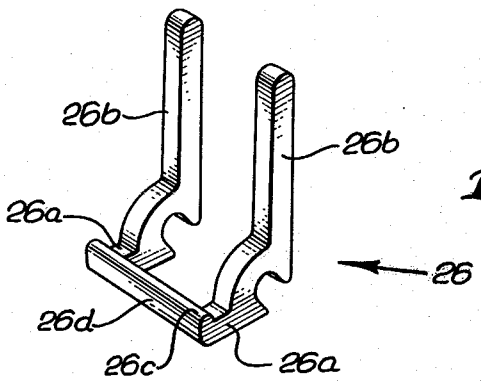
FIG. 5 is a perspective view of the locking lever used to lock the tractor assembly to the platen of the printer.

As may be seen most clearly in FIG. 5, a lever 26 may be included on each side of the tractor 16 in order to provide a balanced clamping force. In such a case, two cam action knobs 30 are included and are operated in unison so that the levers 26 are actuated uniformly. In addition, a bar 26*d* may be connected between the free ends of the legs 26*a* in order to provide a more even clamping force. The shape of the connected levers 26 may be seen clearly by reference to FIG. 5.

Thus, it can be seen that the present invention provides a simple device which positively locks the tractor 16 in position with respect to the platen 14 of the printer 10. The locking prevents both horizontal and vertical motion of the tractors 16 with respect to the platen 14. For purposes of economy, it is preferred that the lever 26 and knob 30 be molded from plastic, although other materials could be employed.

Figure 7:
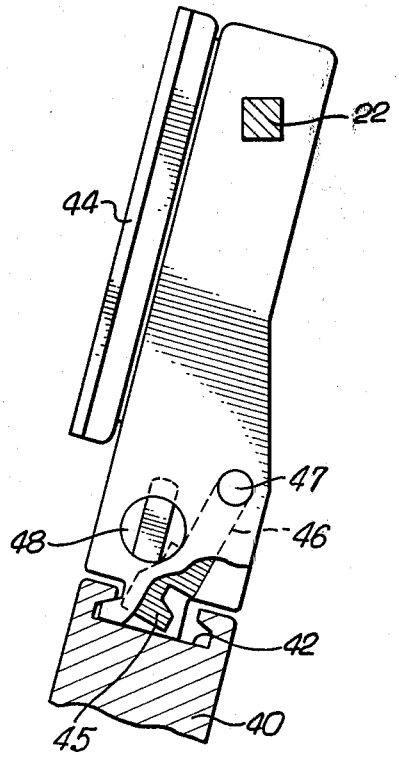
FIGS. 7 and 8 are views of an alternate tractor and platen assembly which minimizes rocking of the tractor.
Figure 8:
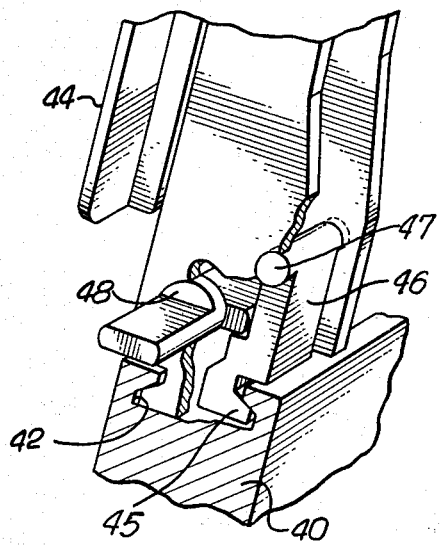

In the system which has been described, the tractor 16 has a slight tendency to rock back and forth on the top of the platen 14 when the drive bar 22 is warped. FIGS. 7 and 8 show an alternate arrangement of the tractor and platen assembly which minimizes this tendency. The platen 40 includes a T-shaped groove 42 on its upper surface, and the L shaped locking lever 46 includes a generally L-shaped tongue 45 extending from its lower surface. The L-shaped locking lever 46 is pivotally attached to the tractor 44 by means of pivot 47. The tongue 45 slides into the groove 42 with the lower leg of the L facing forward and holds the tractor 44 flat against the platen 40. A cam action knob 48 is used to pivot the lever 46 rearward about pivot 47 and lock it into a locked position in the groove 42. As compared with the previously described embodiment, the system of FIG. 7 has less tendency to rock back and forth under the influence of a warped drive bar 22. The basic operation, however, is essentially the same.

In a second alternate embodiment, a platen having a T-shaped groove is still utilized, but the L-shaped lever 46 is replaced with a cylindrical lock 50, as shown in FIGS. 9, 10 and 11*a*, *b*, and *c*. The lock 50 is carried within a circular opening 52 in a tractor body 54. The tractor body 54 includes a pair of protrusions 54*a* which fit into the top of the T-shaped groove 42 in order to position the tractor 44. The lock 50 includes a knob 50*a* which is connected to the top of the cylindrical lock 50 and a pair of opposed locking wedges 50*b* extending radially from the bottom of the cylindrical lock 50. As can be seen most clearly in FIGS. 10 and 11*a*, *b*, and *c*, by rotating the knob 50*a*, the wedges 50*b* will engage the locking groove 42, thus locking the tractor 44 in position. By slightly rotating the lock 50 from its locked position (FIG. 11*a*) to an unlocked position (FIG. 11*b*), the position of the tractor 44 along the platen 40 can be changed. By rotating the lock 50 a full ninety degrees from its locked position, it will be in a released position (FIG. 11*c*) in which the wedges 50*b* are parallel to the groove 42, thereby enabling the tractor 44 to be completely removed from the platen 40, when the entire tractor assembly is removed from the printer 10.

Although the invention has been described in terms of a particularly shaped locking lever, the basic idea of the invention is to secure the tractor assemblies directly to the platen. The direct connection prevents any relative motion between the tractor assembly and the platen despite a lack of straightness in the drive bar. The device is extremely simple, yet provides a secure clamping action. The resultant system enables high accuracy incremental paper motion to be achieved in a tractor-type drive system. It is recognized that modifications and variations of the described embodiments may readily occur to those skilled in the art, and consequently it is intended that the claims be interpreted to cover such modifications and equivalents.

We claim:

1. In a printer or the like having a stationary platen and utilizing a tractor-type incremental paper drive system driven by a rotating drive bar, a system for achieving high accuracy incremental paper motion comprising:

a tractor drive assembly for moving paper across said platen; and means connected to the tractor drive assembly for locking said tractor drive assembly directly to said platen, whereby the position of the tractor drive assembly is maintained fixed despite any lack of straightness of the drive bar.

2. In a printer or the like having a stationary platen and utilizing a tractor-type incremental paper drive system driven by a rotating drive bar, a system for achieving high accuracy incremental paper motion comprising:

a tractor drive assembly for moving paper across said platen;

locking means connected to the tractor drive assembly for locking said tractor drive assembly in direct contact with and in a fixed position with respect to said platen; whereby the position of the tractor drive assembly is maintained fixed despite any lack of straightness of the drive bar;

wherein said platen includes a vertical portion and a rearwardly extending horizontal portion attached to the top of said vertical portion, and said locking means operates to force the bottom of said tractor drive assembly against said horizontal portion of the platen.

3. In a printer or the like having a stationary platen and utilizing a tractor-type incremental paper drive system, a system for achieving high accuracy incremental paper motion comprising:

a tractor drive assembly for moving paper accross said platen; and means connected to the tractor drive assembly for locking said tractor drive assembly in direct contact with and in a fixed position with respect to said platen, wherein said platen includes a vertical portion and a rearwardly extending horizontal portion attached to the top of said vertical portion, and said locking means operates to force the bottom of said tractor drive assembly against said horizontal portion of the platen, wherein said locking means includes:

a generally L-shaped first lever having a first leg which extends horizontally between the horizontal portion of the platen and a second leg extending generally vertically upward along the side of the tractor drive assembly, said first lever being pivotal about a post which extends from the side of the tractor drive assembly, wherein when said first lever is pivoted to a first position, the horizontal portion of the platen will be clamped between the bottom of the tractor drive assembly and the first leg.

4. A system according to claim 3 wherein said locking means further includes a cam action knob attached to the tractor drive assembly cooperating with the vertical second leg of the first lever, wherein the cam action knob is movable to pivot the lever into the first position in order to lock the lever and into a second position in order to unlock the lever.

5. A system according to claims 3 or 4 including a second lever indentical to the first lever and located on the other side of said tractor drive assembly, said second lever providing a balanced clamping force to secure the tractor drive assembly to the platen.

6. A system according to claim 5 wherein said first and second levers are connected to one another by means of a bar attached to the end of each first leg.

7. A system according to claim 6 wherein the horizontal portion of the platen includes a downwardly extending lip located at its free end, thereby forming a groove on the underside of the horizontal portion, and wherein said bar is raised with respect to the top of the first legs, whereby said bar engages said groove and is retained by said lip.

8. A system according to claims 3 or 4 wherein said locking means is made of molded plastic.

9. In a printer or the like having a stationary platen and utilizing a tractor type incremental paper drive system, a system for achieving high accuracy incremental paper motion comprising:

a tractor drive assembly for moving paper across said platen; and means connected to the tractor drive assembly for locking said tractor drive assembly in direct contact with and in a fixed position with respect to said platen, wherein said platen includes a groove formed in its upper surface and said tractor drive assembly includes a tongue extending from its lower surface, wherein said tongue cooperates with said groove to position the tractor drive assembly.

10. A system according to claim 9 wherein said locking means includes a lever, pivotally connected to the tractor drive assembly, said lever being movable into locking engagement with the groove in the platen.

11. A system according to claim 10 wherein said tongue is generally L-shaped and said groove is generally T-shaped.

12. In a printer or the like having a stationary platen and utilizing a tractor-type incremental paper drive system, a system for achieving high accuracy incremental paper motion comprising:

a tractor drive assembly for moving paper across said platen; and means connected to the tractor drive assembly for locking said tractor drive assembly in direct contact with and in a fixed position with respect to said platen, wherein said platen includes a locking groove located on its top surface, said locking groove including a vertical portion and a horizontal portion located at the bottom of the vertical portion, and said means for locking includes a locking member extending downwardly from said tractor drive assembly and into the locking groove, wherein said locking member includes at least one locking wedge extending horizontally from the bottom of the locking member and wherein the locking member is rotatable so as to engage the locking wedge with the horizontal portion and thereby lock the tractor drive assembly to the platen.

* * * * *